US005419244A

United States Patent [19]

Kutman

[11] Patent Number: 5,419,244

[45] Date of Patent: May 30, 1995

[54] SENSOR SYSTEM FOR SELECTIVELY ADJUSTING THE PRINTING STROKE OF A SCREEN PRINTING PRESS

[75] Inventor: Pyotr Kutman, Wilmette, Ill.

[73] Assignee: A.W.T. World Trade, Inc., Chicago, Ill.

[21] Appl. No.: 238,372

[22] Filed: May 5, 1994

[51] Int. Cl.[6] ..... B41F 15/42

[52] U.S. Cl. ..... 101/123; 101/486

[58] Field of Search ..... 101/114, 123, 129, 484, 101/485, 486

[56] References Cited

U.S. PATENT DOCUMENTS

| | | | |
|---|---|---|---|
| 4,414,894 | 11/1983 | Bailly | 101/123 |
| 5,170,703 | 12/1992 | Tu et al. | 101/123 |
| 5,232,544 | 8/1993 | Sumi | 101/123 |
| 5,239,923 | 8/1993 | Belcher et al. | 101/123 |
| 5,339,732 | 8/1994 | Peterlini et al. | 101/123 |

*Primary Examiner*—Edgar S. Burr
*Assistant Examiner*—Stephen R. Funk
*Attorney, Agent, or Firm*—Silverman, Cass & Singer

[57] ABSTRACT

A sensor system utilized with a screen printing press for selectively adjusting a length and relative position of the front and rear ends of a printing stroke to traverse a variably sized and positioned image area being applied to a substrate. The sensor system includes fixed reference sensors mounted on the printing press for detecting the position of the front and rear ends of the printing stroke and indicating a distance along which the carriage travels. The sensor system permits the stroke length and the relative position of the printing stroke proximate the image area to be readily adjusted by varying the position of the carriage and monitoring the stroke length of the printing stroke between the front and rear positions.

20 Claims, 2 Drawing Sheets

SENSOR SYSTEM FOR SELECTIVELY ADJUSTING THE PRINTING STROKE OF A SCREEN PRINTING PRESS

FIELD OF THE INVENTION

This invention relates generally to screen printing presses and more particularly, relates to an improved sensor system for selectively adjusting the length of the printing stroke and the relative positions of the front and rear ends of the printing strokes.

BACKGROUND OF THE INVENTION

During a printing cycle in a conventional screen printing operation, it is necessary normally to move a pool of printing ink across a screen toward one end of it, in a "flood stroke", then to position the screen immediately on top of the work, lift the flood bar and lower a squeegee bar extending across the width of the screen into contact with the screen. Then, the rubber squeegee is drawn in the opposite direction across the screen to force ink through the pores of the screen in the areas desired so as to print the underlying work corresponding to those image areas of the screen through which ink has been forced.

Usually, the flood bar and squeegee are mounted on a carriage which is reciprocable along a pivotally mounted printing head. Printing with the squeegee is effected as the carriage travels from the front to the rear of the printing head. Upon reaching the rear end of the printing head, the carriage reverses direction in order to flood the screen and carry the squeegee back to its starting position at the front end of the printing head. The path of the carriage from the front end to the rear end of the printing head is defined as the printing stroke. In order to produce prints of varying size and length and of multiple colors, it is desirable to vary the length of the printing stroke as well as the position of the front and rear ends or stroke positions respectively of the printing stroke.

Various types of apparatus have been developed to reciprocate the carriage carrying the flood bar and the squeegee across the screen and to reverse their positions during the press cycle. Such apparatus generally includes an electric motor which drives the carriage through some type of mechanical linkage therebetween.

Various types of systems have been used for adjusting the length of the printing stroke and the front and rear ends thereof. Electrical sensors have been used to manipulate operation of the motor which drives the carriage. Adjustment of these systems, however, proved to be time consuming for the operator who had to make the adjustments individually and manually at locations on the carriage or printing head, as the case might be.

A reliable system was found to be one in which the length of the printing stroke is varied by adjusting the mechanical linkage between the drive motor and the carriage. One mechanism of this type is described in U.S. Pat. No. 3,859,917 to Bubley, et al. Although reliable, adjustment of the printing stroke required stopping the press and removing access covers to the linkage inside the press. This manipulation of the linkage was disadvantageous and time consuming.

Other means resorted to for controlling the carriage so as to adjust the length of the printing stroke comprised movable sensing devices positioned along the length of the printing head. These took the form of photo-sensors, photo-switches, proximity switches, and limit switches to set the limits of the stroke by manually positioning the front and rear stop positions of the carriage. Such sensing devices, however, required mechanical changing of their positions each time adjustment in stroke length was desired. After the mechanical adjustment of the sensor's position was made, the results or accuracy of the adjustment could not be ascertained except after a trial run. This was time consuming and subject to adjustment error because of the manipulation and manual operation required to achieve the desired adjustments.

It therefore would be desirable to provide a sensor system which readily permits selective adjustment of the length of the printing stroke as well as the relative positions of the front and rear ends or stroke positions of the printing stroke. It would also be desirable to be able to adjust the printing stroke without the necessity of manual manipulation of the reference sensors or of the carriage drive linkages. It further would be desirable that the adjustment of the printing stroke be readily accomplished by positioning the carriage in the front and rear stroke positions proximate the image areas of the screen through which the ink will pass. In addition, it is desirable that these adjustments be accomplished rapidly and economically.

SUMMARY OF THE INVENTION

The invention is a sensor system utilized with a screen printing press for selectively adjusting a length and relative position of the front and rear ends of a printing stroke in order to traverse variably sized and positioned image areas through which ink will be applied to a substrate. The sensor system includes fixed reference sensors mounted on the printing press for detecting the position of a carriage relative to the sensors and an additional sensor indicating a distance along which the carriage travels. The sensor system permits the stroke length to be readily adjusted by varying the front and rear end positions of the carriage with respect to the reference sensor while monitoring the stroke length of the printing stroke therebetween.

DESCRIPTION OF THE PREFERRED EMBODIMENTS

Figure 1:
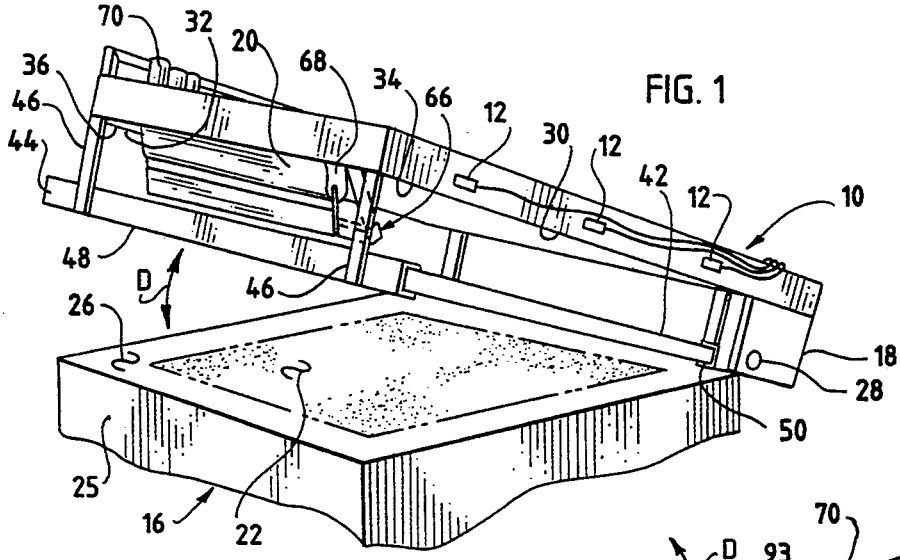
FIG. 1 is a partial perspective view of a screen printing press illustrating the press bed, the substrate, the print head in a raised position and the reference sensors of the invention.
Figure 2:
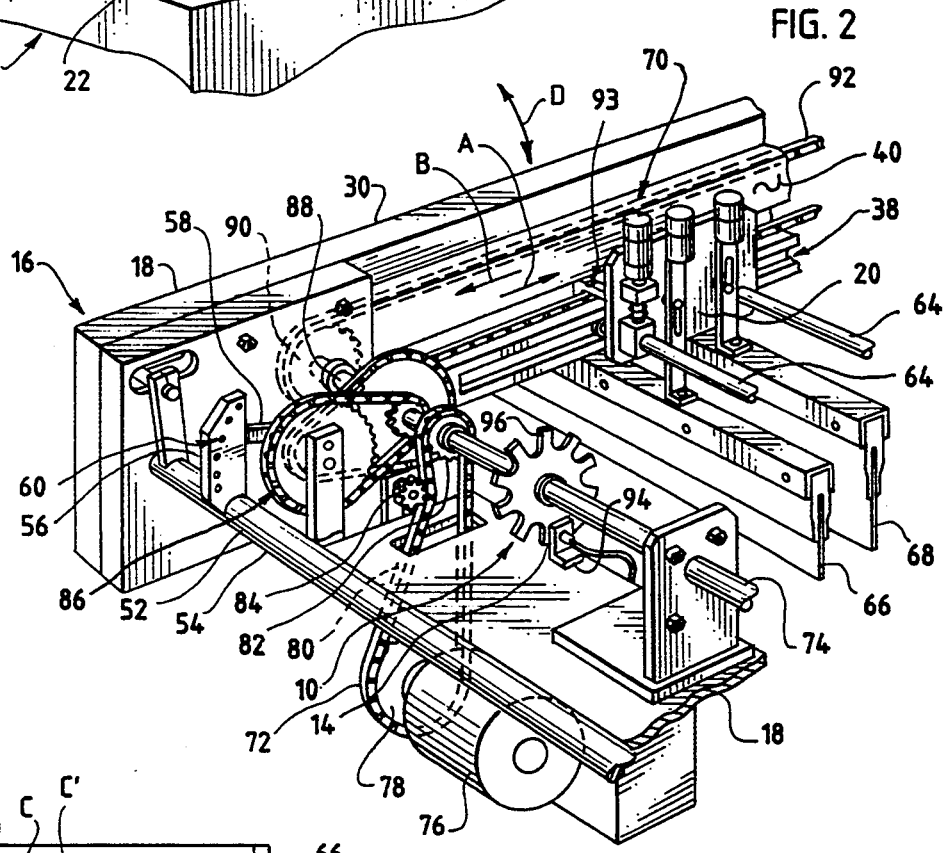
FIG. 2 is a partial rear perspective view of the printing head of the press of FIG. 1 illustrating the carriage drive assembly with covers removed and the carriage.

Referring to FIGS. 1 and 2, the sensor system of the invention generally is designated by the reference numeral 10. The sensor system 10 preferably includes three reference sensors 12 and an encoder 14 provided in combination with a screen printing press 16 having a print head 18 and a carriage 20.

Figure 3:
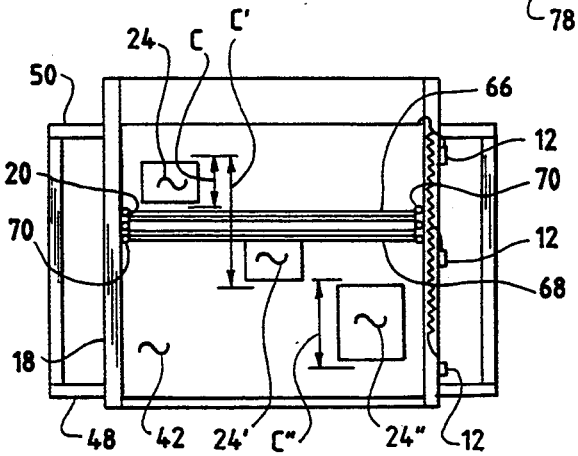
FIG. 3 is a partial top plan view of the screen printing press illustrating the carriage and three possible image areas through which ink may be provided to the substrate.

Briefly, in operation, a substrate 22 is positioned on the printing press 16, the print head 18 is pivoted downward onto the substrate 22 and the carriage 20 is cycled to perform a printing operation thereto. During the printing operation, the carriage 20 typically reciprocates through a flood stroke in the direction of arrow A as seen in FIG. 2 and then, through a printing stroke in the direction of arrow B. As FIGS. 2 and 3 illustrate, the printing stroke traverses an image area 24 through which ink will be forced and has a stroke length generally indicated by arrow C. In the alternative, other possible image areas 24' and 24" having variable sizes or positions as generally seen in FIG. 3 may be provided. To print the image areas 24, 24' or 24", the sensors 12 and the encoder 14 of the sensor system 10 are utilized which permit adjustment of the stroke length indicated by arrow C as well as the relative position of the printing stroke. In adjusting the printing stroke, the reference sensors 12 of the sensor system 10 detect the position of the carriage 20 relative thereto, and the encoder 14 of the sensor system 10 serves to indicate the distance being travelled by the carriage 20.

As FIG. 1 illustrates, the screen printing press 16 includes a press frame 25 situated in a predetermined on-site location. To support the substrate 22 during the printing operation, the press frame 25 is formed with a horizontal press bed 26.

The print head 18 is pivotally mounted to the press frame 25 by a pivot rod or pin 28 in order to permit rotation of the print head 18 along the directions of arrow D as seen in FIGS. 1 and 2. To permit transfer of the substrate 22 before and after printing, the print head 18 pivots upwardly off the substrate 22 as FIG. 1 illustrates. Conversely, to perform a printing operation on the substrate 22, the print head 18 pivots downwardly as FIG. 2 illustrates.

The print head 18 includes carriage support arms 30, 32 having free ends 34, 36 respectively as seen in FIG. 1. To support and guide the carriage 20, each carriage support arm 30, 32 is formed with a carriage arm slide 38 on an inside face 40 as FIG. 2 illustrates.

Referring to FIG. 1, to provide a screen 42 to be disposed adjacent the substrate 22 during the printing operation, the print head 18 also includes a masterframe 44 suspended therefrom by suspension arms 46. The screen 42 seats between a front screen holder 48 and a rear screen holder 50 which are preferably formed with a C-shaped cross-section.

To allow safe and ready access to the screen holders 48, 50 for installation or replacement of the screen 42, the masterframe 44 preferably is detachable from the suspension arms 46 and the print head 18 is adapted to pivot upwardly separate from the masterframe 44. To accommodate different size screens 42, the rear screen holder 50 may be repositioned toward or away from the front screen holder 48 accordingly.

Not only may different size screens 42 be provided, but the image areas 24 through which ink will pass to the substrate 22 may vary depending upon the particular design being applied to the substrate 22. As FIG. 3 illustrates, the image areas 24, 24' and 24" may differ in size and relative position on the screen 42.

To raise or lower the print head 18, an independent peel or head lift drive assembly 52 is provided, one embodiment of which is generally illustrated in FIG. 2. It should be appreciated that peel lift drives are known to the skilled artisan and the particular peel lift drive used in combination with the sensor system 10 of the invention may be varied.

The preferred peel lift drive assembly 52 includes a shaft 54 secured at each end to the print head 18 by bolts or other methods of fastening. An upwardly disposed casting 56 is welded to the shaft 54. To provide a rotational torque to raise and lower the print head 18, a drive rod 58 is removably secured to the casting 56 at a drive rod bolt hole 60.

To propel the drive rod 58 and provide the rotational torque, the drive rod 58 preferably connects to a cam follower (not illustrated) which is operably engaged with a cam (not illustrated). A head drive motor 62 (not illustrated in FIG. 2) serves to selectively oscillate the cam (not illustrated) and consequently, to control the raising or lowering of the print head 18 in the direction of arrow D. The head drive motor 62 (not illustrated) preferably is a direct current motor.

To adjust the rate at which the print head 18 raises, a plurality of the drive rod bolt holes 60 are provided on the casting 56, any one of which may be used to anchor the drive rod 58. As is well known in the art, adjusting the rate of lift of the print head 18 during the printing stroke serves to vary a peel rate of the screen 42 illustrated in FIG. 1.

The carriage 20 has a pair of guide rods 64 extending between the carriage support arms 30, 32, the ends of which are slidably mounted within the carriage arm slides 38 as FIG. 2 illustrates. As FIGS. 2 and 3 illustrate, the carriage 20 further includes a rearwardly disposed flood bar 66 to move a pool of ink across the screen 42 during the flood stroke, a forwardly disposed squeegee 68 to force the ink through the image areas 24 of the screen 42 during the printing stroke, and a control apparatus 70 therefor. It should be appreciated that the specific operation and construction of the carriage 20 would be known to one skilled in the art of silk screen printing presses.

To provide reciprocating movement to the carriage 20, a carriage stroke drive 72 (illustrated with covers removed in FIG. 2) is mounted on the print head 18. The carriage stroke drive 72 preferably comprises a chain driven rotatable shaft 74 operably engaged with a carriage drive motor 76. The carriage drive motor 76 preferably is a direct current motor. The shaft 74 is rotated by the carriage drive motor 76 through a drive sprocket 78, a shaft drive chain 80, a shaft sprocket 82 and an idler sprocket 84 supported by a bracket (not illustrated).

To reduce the rotational speed transmitted by the shaft 74, a series of speed reducing sprockets 86 are provided which connect to a low speed shaft 88. The shaft 88 drives a sprocket 90 disposed within the carriage support arm 30 which in turn drives an endless carriage drive chain or belt 92. To move the carriage 20 along the carriage support arm 30 in the direction of arrows A and B in response to the carriage drive motor 76, the carriage drive chain 92 operably engages the carriage 20 by an arm 93.

To indicate the rotation of the shaft 74 and accordingly, the distance travelled by the carriage 20, the encoder 14 is provided. Preferably, the encoder 14 includes a photo-sensor 94 secured in position which detects the rotation of a star wheel 96 mounted on the shaft 74. It should be appreciated that other methods which serve the purposes described herein would be apparent to the skilled artisan in order to detect the rotation of the shaft 74 and indicate the travel of the carriage 20.

To detect the relative position of the carriage 20 along the carriage support arms 30, 32, the sensors 12, preferably three, are provided in fixed, spaced apart positions on the carriage support arm 30 as FIG. 1 illustrates. Preferably, the sensors 12 are magnetically actuated sensing means which detect a magnet (not illustrated) mounted on the moving carriage 20. Other types of sensors, however, may be used so long as they detect the passage of the carriage 20.

Figure 4:
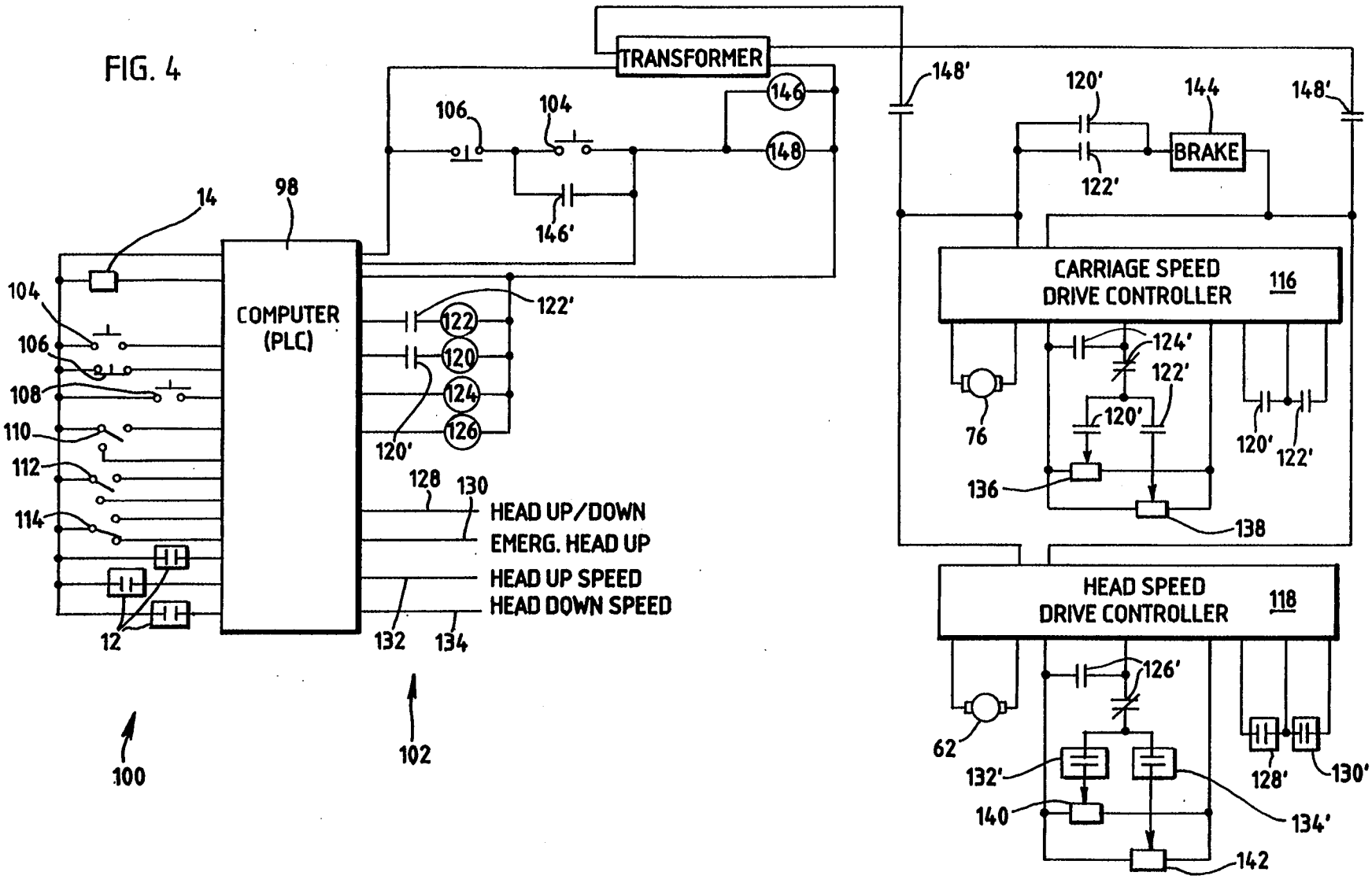
FIG. 4 is a schematic diagram illustrating a preferred control circuit for operating the sensor system in combination with the printing press.

Control of the printing press 16 in combination with the sensor system 10 of the invention preferably is accomplished by a computer 98 as generally illustrated in the schematic diagram of FIG. 4. The computer 98 is a programmable logic controller (PLC) or other type of computer control device known in the art which is readily programmable and serves to not only control the printing press 16 (illustrated in FIGS. 1–4) but to do so in conjunction with the sensor system 10 of the invention.

Programming of the computer is accomplished by a typical programmer device (not illustrated) which connects to the computer 98 and which may be disconnected therefrom after programming or permanently affixed to the printing press 16. The specific program or logic entered into the computer 98 may be varied in view of the disclosure provided herein and the requirements of the particular printing press being operated.

FIG. 4 generally illustrates the circuit and devices pertinent to the operation of the sensor system 10 in combination with the printing press 16. It should be appreciated that additional functions, devices and operations may be incorporated therewith as one skilled in the art would appreciate.

The computer 98 is provided with a plurality of inputs generally indicated by reference numeral 100 and outputs indicated by reference numeral 102. The inputs 100 include the encoder 14, a start button 104, a stop button 106 which may serve as an emergency stop button, a jog button 108 for selectively cycling the print head 18 and the carriage 20 when depressed, and a print head switch 110 for raising and lowering the print head 18 with the masterframe 44 detached, preferably without cycling the carriage 20.

To permit adjustment of the stroke length and the relative position of the printing stroke proximate one of the image areas 24, 24' or 24" or combinations thereof, the inputs 100 also include a stroke length position switch 112 and a stroke adjustment switch 114. The stroke length position switch 112 is a 3-position switch and the stroke adjustment switch 114 is typically a push-button although a 2-position switch or the like may be used.

To set the front stroke position of the printing stroke, the stroke length position switch 112 is actuated, the stroke adjustment switch 114 is actuated which serves to selectively cycle the carriage 20 to the desired front stroke position without cycling the print head 18, and then, the stroke length position switch 112 is released to a center off position to signal the computer 98 to store the front stroke position. The rear position of the printing stroke is similarly set by actuating the stroke length position switch 112 to a rear set position, actuating the stroke adjustment switch 114 to selectively cycle the carriage 20 and then, releasing the switch 112 to store the rear stroke position.

During setting, the encoder 14 serves to indicate the distance travelled by the carriage 20 by providing a signal to the computer 98 which is generated upon rotation of the star wheel 96 illustrated in FIG. 2. In response, the computer 98 seen in FIG. 4 monitors and preferably stores the distance travelled between the front and rear stroke positions or more specifically, stores the stroke length of the printing stroke.

The inputs 100 also include the reference sensors 12. As the reference sensors 12 detect the passage of the carriage 20, the relative position of the carriage 20 with respect to the sensors 12 is provided to the computer 98. The computer 98 stores the carriage position as a front or rear stroke position if the stroke length switch 112 is actuated to the front or rear set positions respectively and then released during a setting operation. It should be appreciated that a greater or lesser number of sensors 12 may be provided, as desired.

The outputs 102 are selectively controlled by the computer 98 to govern the operation of the printing press 16 including a carriage speed drive controller 116 and a head speed drive controller 118. The carriage speed drive controller 116 and the head speed drive controller 118 preferably are d.c. drive speed controllers.

To control the operation of the carriage speed drive controller 116, the outputs 102 include a flood control relay 120 for actuating the flood stroke, a print control relay 122 for actuating the printing stroke, and a carriage jog relay 124 to selectively reposition the carriage 20 independent of the print head 18 and the printing operation. The corresponding relay contacts associated with each of the outputs described herein are designated by the prime of the reference numeral, i.e. 120 and 120'.

To control the operation of the head speed drive controller 118, the outputs 102 include a head jog relay 126 to selectively actuate the print head 18 independent of the carriage 20 and the printing operation, a head up/down output 128 to actuate the print head 18 during the printing operation, an emergency head up output 130 to raise the print head 18, a head up speed output 132 and a head down speed output 134.

In communication with the carriage speed drive controller 116 is a flood speed control 136 and a print speed control 138 to maximize production rates and print quality. Preferably, the speed controls 136, 138 are independently adjustable potentiometers which serve to vary the carriage drive motor 76 during the respective flood and printing strokes. Similarly, a head up speed control 140 and a head down speed control 142, which are also potentiometers, may be provided to coordinate the operation of the head drive motor 62 with the carriage drive motor 76 during the printing operation.

To stop the carriage 20 and permit a change in stroke direction, a brake 144 is provided. The brake 144 is actuated in response to the energizing of the relays 120 or 122.

In operation, the start button 104 is depressed which provides a signal to the computer 98 and further serves to energize a relay 146 and a relay 148. If necessary, the stop button 106 may be depressed in order to break the circuit, de-energize the relays 146, 148 and stop the operation of the carriage 20 and the print head 18.

As FIG. 3 illustrates, the image areas 24, 24' or 24" through which ink will be applied to the substrate may have different sizes or positions. To accommodate these variations, the front and rear stroke positions of the printing stroke are readily adjusted to traverse the image areas 24 and provide the desired stroke length C or in the alternative C′ or C″ corresponding to the alternate image areas 24′ or 24″.

Adjustment of the stroke length and the relative positions of the printing stroke is accomplished by actuating the stroke length position switch 112 for the front set position. The stroke adjustment switch 114 is then actuated which energizes the carriage jog relay 124 to selectively cycle the carriage 20 to the desired front stroke position. Releasing the stroke length position switch 112 signals the computer to store the front stroke position relative to the sensors 12.

The rear stroke position of the printing stroke is similarly set by actuating the switch 112 to a rear set position. The stroke adjustment switch 114 is then actuated to selectively cycle the carriage 20 to the rear stroke position in order to traverse the image area 24.

As the carriage 20 cycles, the encoder 14 indicates the distance that the carriage 20 travels by providing a signal to the computer 98. Releasing the switch 112 stores the rear stroke position relative to the sensors 12 as well as the distance travelled between the front stroke position and the rear stroke position i.e. the stroke length of the printing stroke.

During a typical printing operation, the head up/-down output 128 serves to actuate the head drive motor 62 seen in FIG. 4 which starts to lower the print head 18 onto the substrate 22 as illustrated in FIGS. 1 and 2. While the print head 18 is descending to its lower print position, the flood control relay 120 is energized to actuate the carriage drive motor 76 and move the carriage 20 through the flood stroke.

Referring to FIGS. 1, 2 and 4, the computer monitors the distance travelled by the carriage 20 as the carriage 20 moves away from the rear stroke position. Once the carriage 20 is proximate the front stroke position after travelling the stroke length away from the rear stroke position, the print control relay 122 is energized to stop the carriage 20, reverse the carriage drive motor 76 and reciprocate the carriage 20 back across the screen 42.

The carriage 20 thereafter moves through the printing stroke to force ink, for example, through the image area 24 of the screen 42 and apply the ink to the substrate 22. In tandem with the movement of the carriage 20 through the printing stroke, the head drive motor 62 operates to raise the print head 18 upwardly and lift the screen 42 from the substrate 22. Once the carriage 20 has travelled the stroke length through the printing stroke and is proximate the rear stroke position, movement of the carriage 20 is again reversed. In this manner, the carriage 20 may be repetitively cycled to print a desired number of substrates Modifications and variations of the individual structures embodied in the present invention may occur to the skilled artisan in the light of the specification hereof without departing from the scope and spirit of the appended claims.

We claim:

1. A screen printing press having a reciprocal carriage and a sensor system for selectively adjusting the stroke length and relative position of the printing stroke through which the reciprocal carriage travels, said printing press having a variably sized and positioned image area on a screen through which ink is dispensed to a substrate as said carriage travels through said printing stroke, said sensing system comprising:

plural fixed sensing means mounted on said printing press for detecting a first stroke position and a second stroke position of said printing stroke of said carriage relative to said sensing means and for indicating a distance through which said carriage travels, said sensing means being operable to adjust said first and second stroke positions of said printing stroke to vary said stroke length and said relative position of said printing stroke proximate to said image area by selectively positioning said carriage; and control means operably communicating with said sensing means for storing said first and second stroke positions of said carriage with respect to said sensing means, for monitoring said distance travelled by said carriage, for selectively actuating said carriage to reciprocate through said stroke length along said printing stroke, and for reversing said carriage proximate one of said first or second stroke positions as said carriage travels said stroke length away from the other of said first or said second stroke positions.

2. The sensor system as defined in claim 1 wherein said sensing means comprise a plurality of spaced apart reference sensors actuated by said carriage for detecting said first and second stroke positions of said printing stroke relative to said sensors, and indicating means for indicating said distance travelled by said carriage, said indicating means communicating with a carriage drive assembly which is mounted on said printing press and operably engaged with said carriage.

3. The sensor system as defined in claim 2 wherein said indicating means is a sensor which detects movement of said carriage drive assembly during the operation thereof.

4. A screen printing press having a variably sized and positioned image area on a screen through which ink is dispensed to a substrate during a printing operation comprising:

a press frame having a press bed to support said substrate during said printing operation;

a print head pivotally mounted to said press frame and movable between a head down position for printing said substrate and a head up position for removal of said substrate, said print head being operably engaged with head drive means for selectively actuating said print head between said head down position and said head up position;

a carriage assembly slidably mounted on said print head and reciprocal along a variable printing stroke length to dispense said ink through said image area, said variable printing stroke length extending between a front stroke position and a rear stroke position, said carriage assembly operably engaged with a carriage drive means for selectively actuating said carriage assembly through a printing stroke, said carriage assembly including indicating means for indicating a distance along which said carriage assembly travels;

sensing means fixedly mounted on said printing press and actuated by said carriage for detecting said front stroke position and said rear stroke position of said carriage relative to said sensing means; and control means mounted on said printing press in communication with said indicating means and said sensing means for selectively actuating said head drive means, for storing said front and rear stroke positions of said printing stroke relative to said sensing means, for monitoring said indicating means, for selectively actuating said carriage drive means to reciprocate said carriage assembly through said stroke length along said printing stroke, and for reversing said carriage assembly proximate to one of said front or rear stroke positions as said carriage assembly travels said stroke length away from the other of said front or rear stroke positions.

5. The screen printing press as defined in claim 4 wherein said front stroke position and said rear stroke position are spaced said stroke length apart to provide said printing stroke with sufficient stroke length to traverse said image area.

6. The screen printing press as defined in claim 4 wherein said indicating means operably communicate with said carriage drive means to detect said carriage drive means during the operation thereof and indicate the distance travelled by said carriage assembly.

7. The screen printing press as defined in claim 6 wherein said head drive means include a head drive motor to raise and lower said print head independently of said carriage assembly, said carriage drive means include a carriage drive motor to reciprocate said carriage assembly along said printing stroke independently of said print head, and said control means are further provided for coordinating said head drive motor and said carriage drive motor to operate in tandem during said printing operation.

8. The screen printing press as defined in claim 4 wherein said carriage drive means is adapted to selectively position said carriage in said first and second stroke positions to adjust said stroke length and the relative position of said printing stroke proximate to said image area.

9. The screen printing press as defined in claim 8 wherein said control means is further provided for selectively actuating said carriage drive means independently of said head drive means during adjustment of said stroke length and the position of said printing stroke.

10. The screen printing press as defined in claim 4 wherein said sensing means comprise a plurality of reference sensors mounted on said print head and actuated by said carriage assembly.

11. The screen printing press as defined in claim 10 wherein said control means further comprising to a stroke length position device and a stroke adjustment device, said stroke length position device including a front set position and a rear set position each of which is adapted to prompt said control means to actuate said carriage assembly and respectively adjust said front stroke position and said rear stroke position during activation of said stroke adjustment device.

12. The screen printing press as defined in claim 11 wherein said stroke length position device includes a third position to prompt said control means to store said relative positions of said first and second stroke positions and said stroke length therebetween.

13. A screen printing press having a variably sized and positioned image area through which ink is dispensed to a substrate during a printing operation comprising:

a press frame having a press bed to support said substrate during a printing operation;

a print head pivotally mounted to said press frame movable between a head down position for printing said substrate and a head up position for removal of said substrate, said print head operably engaged with head drive means for selectively actuating said print head between said head down position and said head up position;

a carriage assembly slidably mounted on said print head and reciprocal along a printing stroke to dispense said ink through said image area, said printing stroke having a stroke length extending between a first stroke position and a second stroke position, said carriage assembly operably engaged with carriage drive means for selectively actuating said carriage assembly through said printing stroke; and control means mounted on said printing press for controlling actuation of said head drive means and for controlling actuation of said carriage drive means, the improvement comprising:

indicating means operably communicating with said control means and said carriage assembly for indicating a distance along which said carriage assembly travels;

sensing means affixed to said printing press in communication with said control means and actuated by said carriage assembly for detecting a relative position of said carriage assembly with respect to said sensor means; and said control means further provided for storing said first and said second stroke positions of said printing stroke relative to said sensing means, for monitoring said indicating means, for reciprocating said carriage assembly through said stroke length along said printing stroke, and for reversing said carriage assembly proximate one of said first or second stroke positions as said carriage assembly travels said stroke length away from the other of said first or second stroke positions.

14. The printing press as defined in claim 13 wherein said front stroke position and said rear stroke position are spaced said stroke length apart proximate to said image area to provide said printing stroke with sufficient stroke length to traverse said image area.

15. The printing press as defined in claim 13 wherein said sensing means comprise a plurality of reference sensors actuated by passage of said carriage assembly for detecting said first and second stroke positions of said printing stroke relative to said sensors.

16. The printing press as defined in claim 15 wherein said indicating means operably communicate with said carriage drive means of said carriage assembly to detect said carriage drive means during the operation thereof and indicate a distance travelled by said carriage assembly.

17. The printing press as defined in claim 15 wherein said reference sensors are mounted to said print head and spaced apart a predetermined distance one from the other.

18. A method of selectively adjusting a stroke length and relative position of a printing stroke of a carriage of a screen printing press with respect to a plurality of fixed reference sensors, said reference sensors mounted in predetermined locations on the printing press and actuated by passage of said carriage, said method comprising the steps of:

(a) selectively positioning said carriage at a first stroke position of said printing stroke;

(b) storing said first stroke position of said printing stroke relative to said fixed reference sensors;

(c) selectively positioning said carriage at a second stroke position of said printing stroke;

(d) storing said second stroke position of said printing stroke relative to said fixed reference sensors, said second stroke position being spaced apart said stroke length from said first stroke position; and (e) monitoring said stroke length of said printing stroke during positioning of said carriage at said first and second stroke positions.

19. The method of claim 18 further comprising the step of operating said carriage which comprises the steps of:

(i) reciprocally moving said carriage along said printing stroke between said first and second stroke positions to perform a printing operation; and (ii) reversing said movement of said carriage proximate one of said first or second stroke positions of said printing stroke as said carriage moves said stroke length away from the other of said first or second stroke positions.

20. The method of claim 18 wherein the step of monitoring said stroke length includes the steps of indicating a distance travelled by said carriage between said first and second stroke positions and storing said stroke length.

* * * * *

UNITED STATES PATENT AND TRADEMARK OFFICE

CERTIFICATE OF CORRECTION

PATENT NO. : 5,419,244

DATED : May 30, 1995

INVENTOR(S) : Pyotr Kutman

It is certified that error appears in the above-identified patent and that said Letters Patent is hereby corrected as shown below:

Column 9,

In claim 11, line 2, delete "to."

Signed and Sealed this

Eighteenth Day of July, 1995

Bruce Lehman

*Attest:*

BRUCE LEHMAN

*Attesting Officer*

*Commissioner of Patents and Trademarks*